US008756850B2

(12) United States Patent
Dietel

(10) Patent No.: US 8,756,850 B2
(45) Date of Patent: Jun. 24, 2014

(54) FIREARM WITH INTERFACE MODULES FOR FIREARMS

(75) Inventor: Bernd Dietel, Horgen (CH)

(73) Assignee: Armatix Invest GmbH, Zürich (CH)

( * ) Notice: Subject to any disclaimer, the term of this patent is extended or adjusted under 35 U.S.C. 154(b) by 227 days.

(21) Appl. No.: 12/689,647

(22) Filed: Jan. 19, 2010

(65) Prior Publication Data

US 2012/0151814 A1 Jun. 21, 2012

(51) Int. Cl.
*F41A 17/06* (2006.01)

(52) U.S. Cl.
USPC ..... 42/84; 42/70.11

(58) Field of Classification Search
USPC ..... 42/70.08, 70.01, 1.01, 1.08, 70.06, 84; 89/135, 136
See application file for complete search history.

(56) References Cited

U.S. PATENT DOCUMENTS

| | | | | |
|---|---|---|---|---|
| 5,459,957 | A * | 10/1995 | Winer | 42/70.11 |
| 5,787,628 | A * | 8/1998 | Teetzel | 42/1.08 |
| 6,237,271 | B1 * | 5/2001 | Kaminski | 42/70.06 |
| 6,253,480 | B1 * | 7/2001 | Florez | 42/70.11 |
| 6,354,033 | B1 * | 3/2002 | Findley | 42/84 |
| 6,357,156 | B1 * | 3/2002 | Klebes et al. | 42/70.11 |
| 6,763,126 | B2 * | 7/2004 | Recce | 382/120 |
| 7,703,229 | B2 * | 4/2010 | Parhofer et al. | 42/70.01 |
| 2007/0074438 | A1 * | 4/2007 | Parhofer et al. | 42/70.01 |

* cited by examiner

*Primary Examiner* — Samir Abdosh
*Assistant Examiner* — John D Cooper
(74) *Attorney, Agent, or Firm* — Miller, Matthias & Hull LLP

(57) ABSTRACT

A firearm comprising a handle piece, a firearm control means integrated into the firearm, and an interface accessible from the outside for connection to a replaceable firearm module and for transmission of information between the firearm control means and the firearm module.

2 Claims, 10 Drawing Sheets

FIREARM WITH INTERFACE MODULES FOR FIREARMS

The present invention relates, in general, to firearms and, in particular, to a firearm which may be used with various replaceable modules each enabling varying modes of operation of the firearm.

BACKGROUND OF THE INVENTION

Also in firearms, control means in form of hardware and software are more and more widely used. One example thereof are control means preventing unauthorized use of firearms and permitting authorized use of firearms, respectively. Control means for firearms are conventionally adapted for providing control functions and modes of operation specified during manufacture of weapons. However, general legal conditions as well as social expectations with regard to the use of firearms are constantly changing. For example, legal provisions for enhancing safety with respect to the use of firearms (e.g. prevention of use of firearms by unauthorized persons and/or in unauthorized areas) are altered time and again. Criminal offenses which are possible due to unwarranted use of weapons also result in a desire of the public for higher safety standards and levels for firearms. In addition, firearms used, for example, by police and military forces are expected to provide more and more different functions and modes of operations. In all cases, it has so far been required to modify the firearms accordingly—as far as at all possible—for example, by means of mechanical constructional modification, replacement of hardware and/or software of the control means. Even replacement or modification of software involves great efforts since, for example, simple software updates, which are common in conventional software applications, are not applicable in firearms for safety reasons.

OBJECT OF THE INVENTION

It is the object of the present invention to provide measures and means enabling simple supplementation and/or modification of functions and/or modes of operation which can be provided by a firearm.

SUMMARY OF THE INVENTION

For achieving this object, the present invention provides a firearm, a firearm module and a system according to the independent claims. Preferred embodiments are defined in the dependent claims and the following description.

BRIEF DESCRIPTION OF THE DRAWINGS

In the following description, it is referred to the attached drawings, in which.

DESCRIPTION OF PREFERRED EMBODIMENTS

In the following, exemplary embodiments of the present invention are described by reference to the drawings.

As shown in the Figures, a firearm 2 comprises a handle piece 4 with a removable and replaceable handle back 6. If the handle back 6 is removed, access to a region covered by the handle back is obtained, in which region, for example, the preferably replaceable power supply (not shown), e.g. in form of one or more batteries and/or accumulators, is accommodated, for replacing, charging etc. the same. Furthermore, various handle backs may be used, e.g. handle backs adapted to the respective user.

Figure 4:
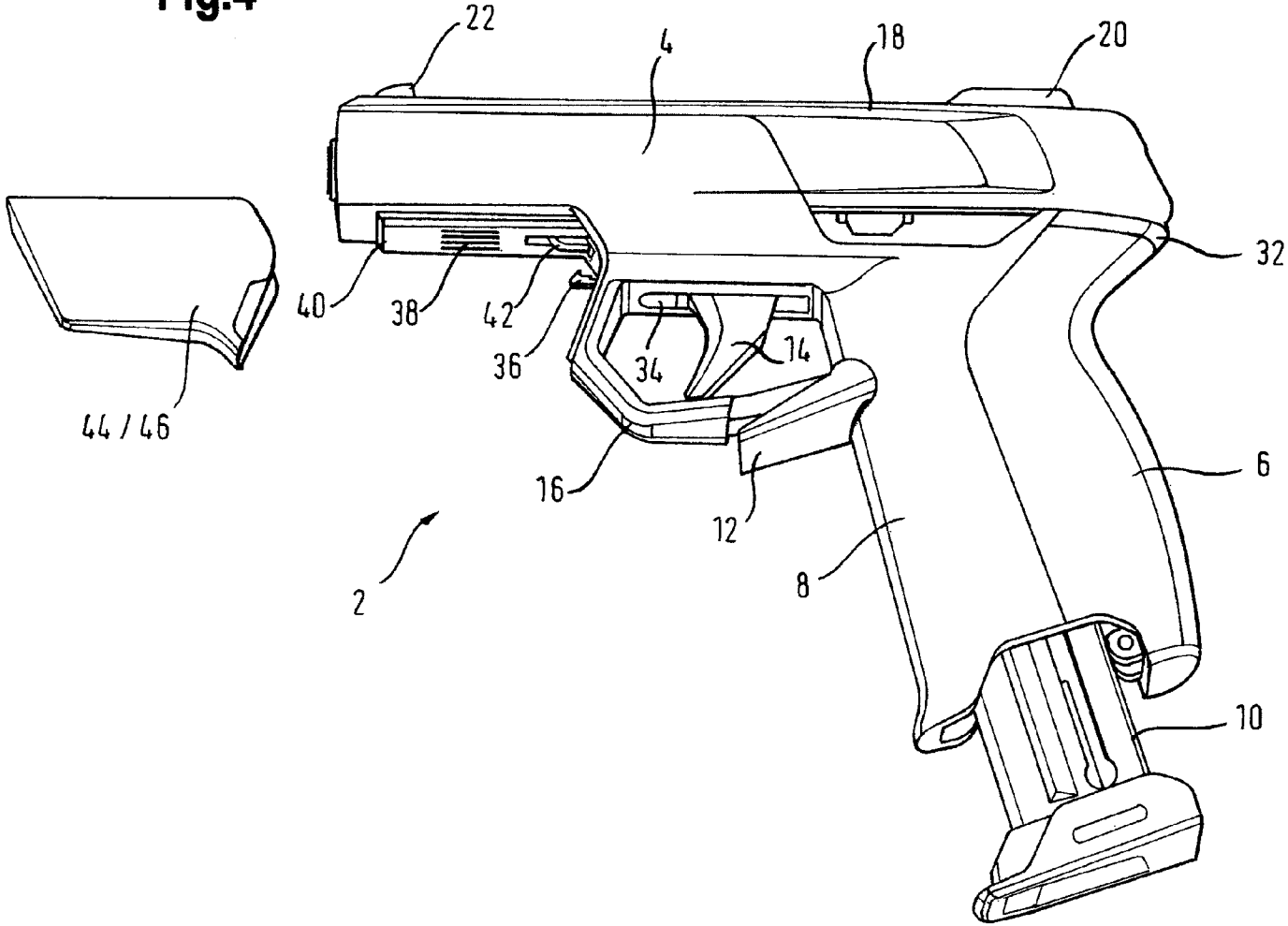
FIG. 4 shows a schematic view of the firearm according to the invention of FIG. 1 with detached cover/firearm module and operated magazine release lever and partially removed magazine.
Figure 5:
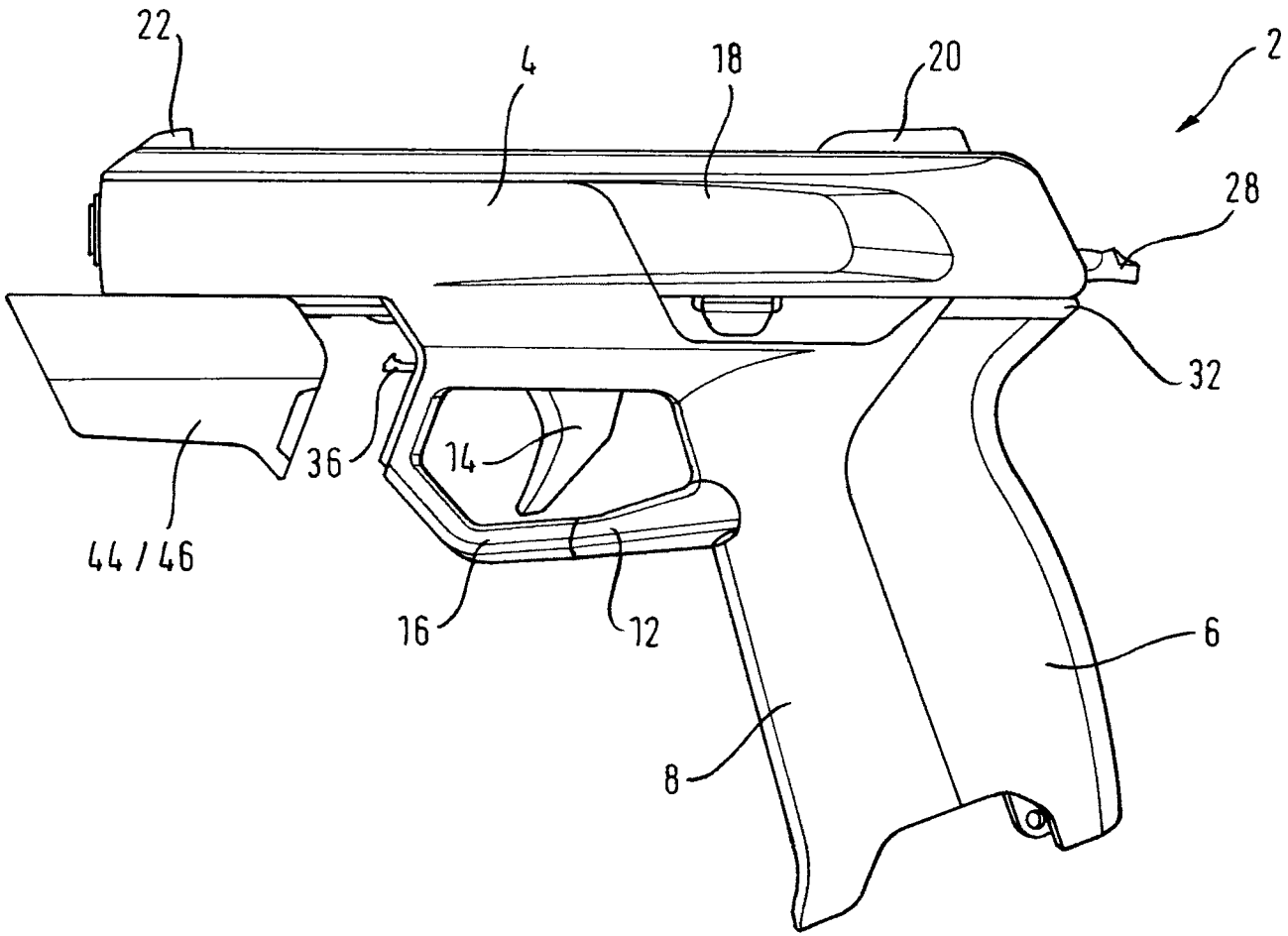
FIG. 5 shows a schematic view of the firearm according to the invention of FIG. 1 with detached cover/firearm module and without magazine.

A removable magazine 10 is provided in the handle 8 of the handle piece 4, which magazine can be released by operating a magazine release lever 12 and removed from the magazine shaft (no reference numeral), which is illustrated for example in FIGS. 4 and 5.

Moreover, the firearm 2 comprises a trigger 14 and a trigger guard 16 as well as a breech 18 with notch sight 20 and bead sight 22. The breech 18 cooperates with a locking spring 24 in a conventional manner, which spring may exert forces on the breech 18 when arranged over the barrel 26 of the firearm 2 in the assembled state. The barrel 26, together with a rocking lever 28, is arranged on a so-called sheet metal cage 30, which carries or comprises further, in particular, metal components of the firearm 2. The sheet metal cage 30 can be inserted from above into the handle piece 4 which is open at the top and may be made completely of plastic material or may comprise plastic portions. In the region of the top end of the handle 8, the sheet metal cage 30 extends into the handle piece 4 so far that it provides room for arranging, inter alia, the magazine 10, the power supply and a (not shown) firearm control means in the interior of the handle 8.

An optical display means 32 is arranged between the rear bottom side of the breech 18 and the handle back 6, which display means is capable of indicating one or a plurality of operating states of the firearm 2. The optical display means 32 may comprise one or a plurality of LEDs and/or one or a plurality of LCD elements and/or other means providing optical signals. The optical display means 32 may, for example, indicate whether the firearm 2 is unlocked or locked and/or—as explained in greater detail below—enabled for firing or not. Such operating states may be indicated, for example, by green (unlocked/enabled) and red (locked/disabled) light signals, wherein operating states may distinguished from each other, for example, by intermittent light signals (flashing) and continuous light signals.

For example, a red continuous light signal may indicate that the firearm 2 is disabled for use by an authorized person and a green continuous light signal may indicate that the firearm 2 is enabled for use by an authorized person so that a shot may be fired.

A red continuous light signal may also indicate that the firearm 2 is (mechanically) locked such that even an authorized person cannot fire a shot, a red flashing light is signal may indicate that the firearm 2 is (mechanically) unlocked such that an authorized person would be unable to fire a shot but the firearm 2 is not enabled to this effect, a green flashing light signal may indicate that the firearm 2 is enabled for use by an authorized person but that the firearm 2 is still (mechanically) locked so that no shot can be fired, and a green continuous light signal may indicate that the firearm is (mechanically) unlocked and enabled for use by an authorized person so that a shot may be fired.

Flashing light signals may further indicate erroneous operating states, such as e.g. a firearm module or interface cover not properly connected to the firearm 2, which states are described in greater detail below.

A firearm module/interface cover release means 34 is arranged in the region of the trigger 16 in front of the trigger 16 in the direction of the barrel according to the illustrations. The firearm module/interface cover release means 34 may be, for example, a surface operable against a spring bias, a lever, a push button and the like. By operating the firearm module/interface cover release means 34, an element 36 is actuated which serves the purpose of locking a firearm module or an interface cover to the firearm 2. The element 36 may be, for example, a latch, hook, catch, notch, etc. and cooperate with correspondingly formed structures on a firearm module or interface cover.

An interface 38 is disposed in the front region at the barrel end below the barrel, which interface is connected to the control means of the firearm 2, on the one hand, and is adapted for connection to a correspondingly formed interface of a firearm module, on the other hand. The interface 38 may be adapted for electric and/or optical and/or inductive and/or magnetic transmission of signals, data and/or information between a firearm module and the control means of the firearm 2. Data, signals, control commands, information etc. can be transmitted between the interface 38 and the control means of the firearm 2 in an electric and/or optical and/or inductive and/or magnetic manner; the same applies to transmissions between the interface 38 and a firearm module. A possibly necessary conversion may be provided by the interface 38 for converting, for example, electric signals of the firearm control means into optical signals for a firearm module and vice versa; the same applies to any further differing ways of transmission.

The interface 38 may also be adapted for providing a firearm module with energy of the power supply of the firearm 2 for operation thereof, if necessary, e.g. in the case is of a firearm module having a passive component (e.g. a memory comprising software) which does not require energy for use thereof, for example, by access thereto by the control means of the firearm 2, transmission of energy via the interface may not be required. However, the interface 38 may preferably, in principle, be adapted for transmission of energy in order to be suitable for any kind of firearm module.

The interface 38 shown by way of example comprises four contacts, i.e. two contacts for transmission of information and two contacts for transmission of energy. In other embodiments, the interface 38 may comprise more or less contacts and/or may be designed as a bus interface. In the case of optical, inductive and/or magnetic transmission, the interface 38 may comprise corresponding inputs and outputs, respectively.

Figure 3:
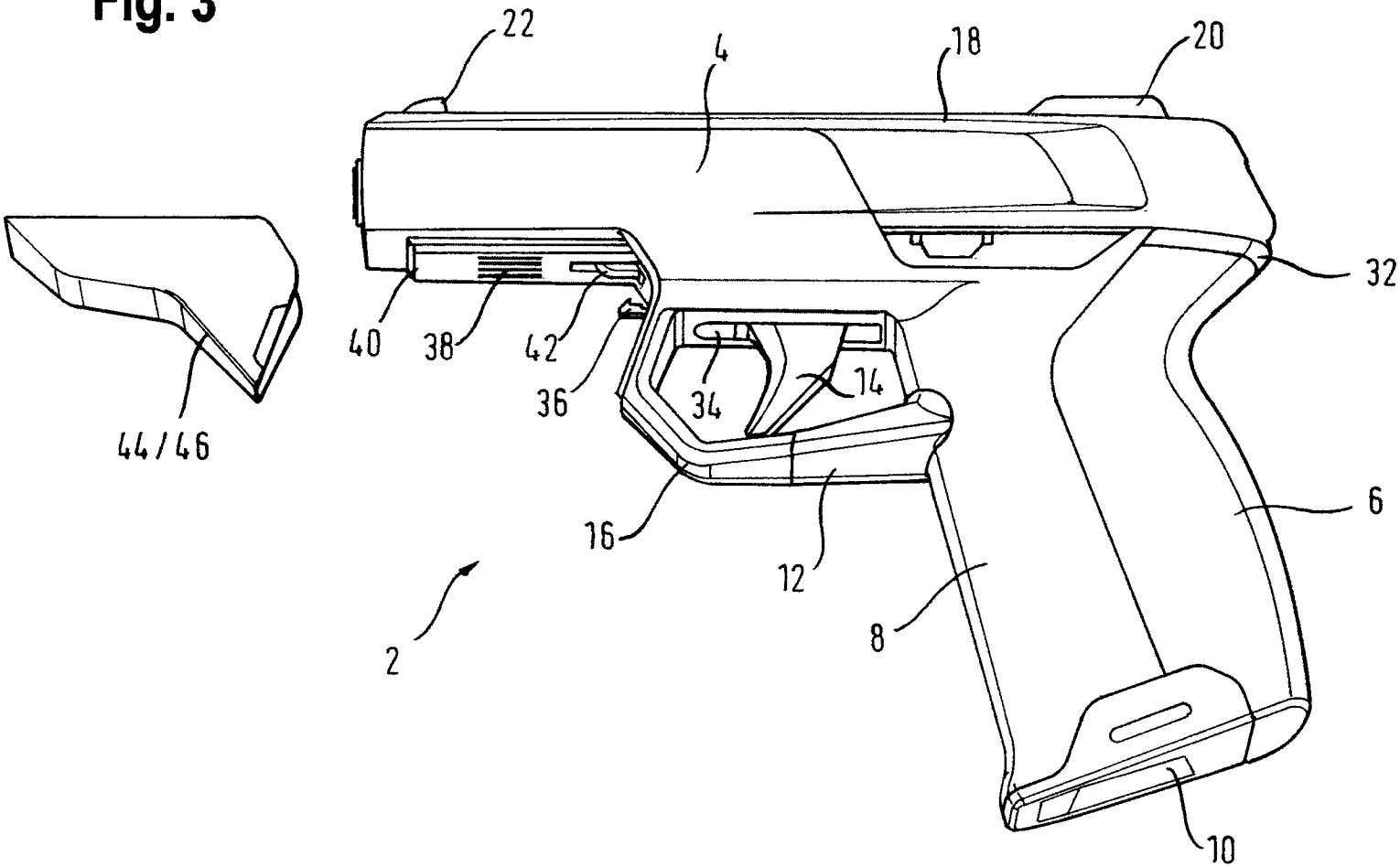
FIG. 3 shows a schematic view of the firearm according to the invention of FIG. 1 with detached cover/firearm module.

A guide means 40 may be provided in the said front region of the handle piece 4, by means of which a firearm module may be guided along the firearm for attachment thereto and/or a firearm module may be positively and/or non-positively held at the firearm. In addition, a breech locking mechanism 42 is arranged in said region. The breech locking mechanism 42 ensures that the breech 18 cannot be removed from the firearm 2. In the non-activated state of the breech locking mechanism 42, shown for example in FIG. 3, the breech 18 can be removed from the firearm 2, e.g. for cleaning etc. It may also be contemplated that the non-activated state of the breech locking mechanism 42 permits the breech 18, for example when firing a shot, to be moved backwards by means of the locking spring 24 and disengaged from the firearm 2. This may provide a further locking means of the firearm 2.

The breech locking mechanism 42 is activated and locks the breech 18, if a firearm module or an interface cover is attached to the firearm 2. This may be achieved, for example, by an operating connection of the breech locking mechanism 42 and a suitably and correspondingly formed structure on the firearm module or interface cover which is then established.

Figure 1:
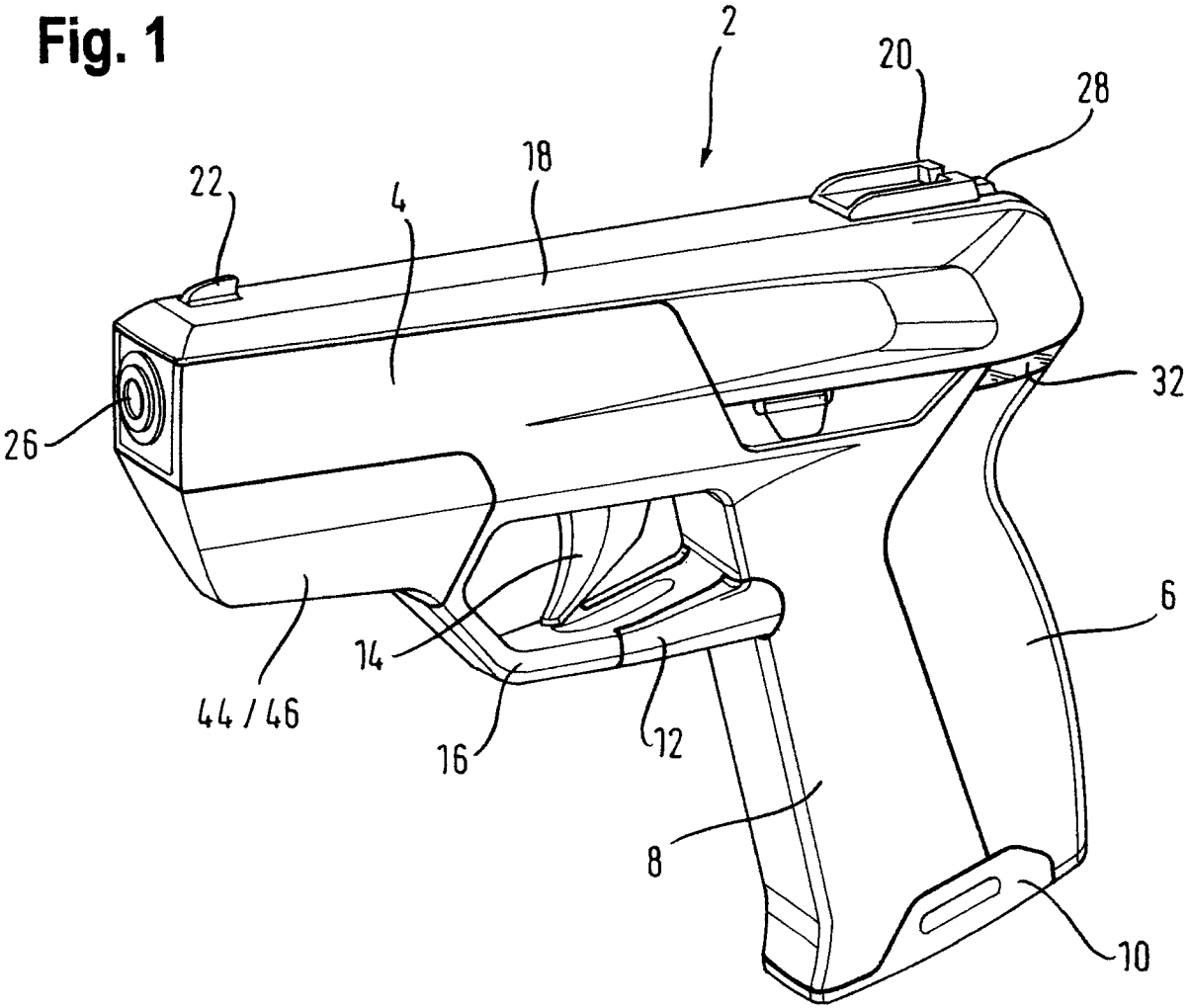
FIG. 1 shows a schematic perspective view of a firearm according to the invention.
Figure 2:
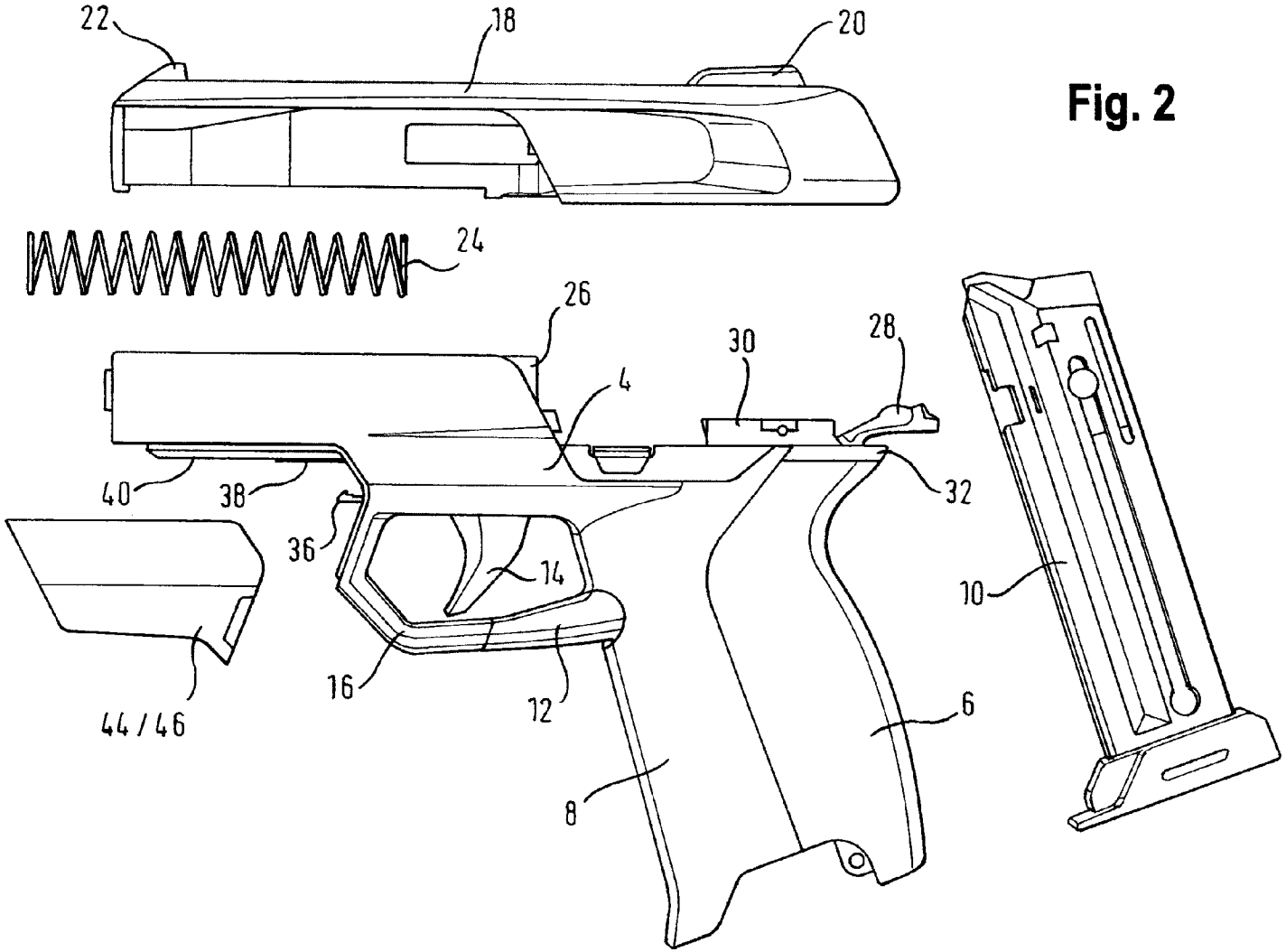
FIG. 2 shows a schematic exploded view of the firearm according to the invention of FIG. 1.
Figure 10:
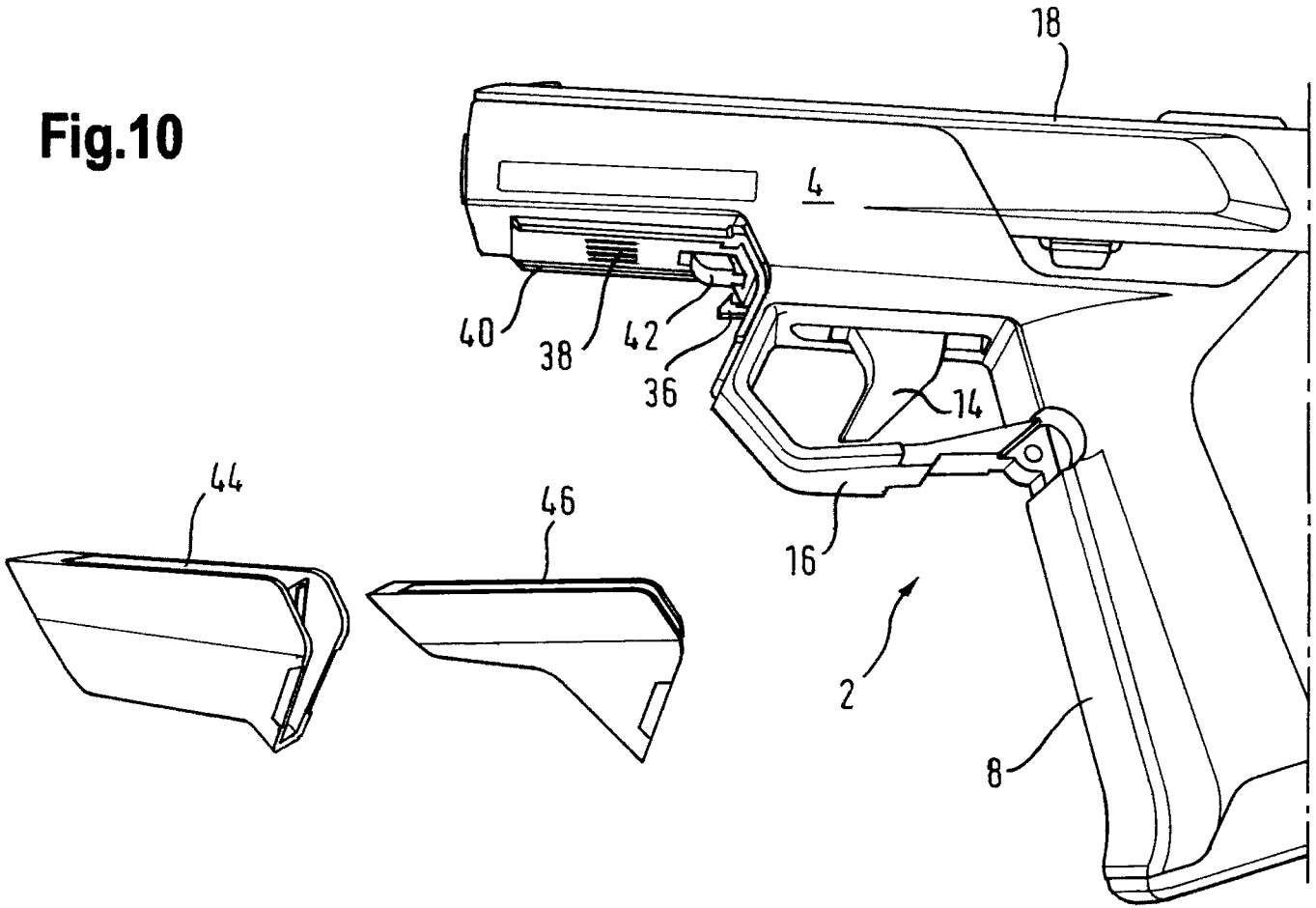
FIG. 10 shows an illustration of the firearm according to the invention of FIG. 7 with embodiments of a firearm module according to the invention and a cover of the firearm module interface.

For example, FIG. 1 shows a firearm module 44 or an interface cover 46 arranged on the firearm 2. In the illustrations according to FIGS. 1-5, it is assumed that the firearm modules 44 and the interface cover 46 are of identical design. In contrast thereto, FIG. 10 shows a firearm module 44 and an interface cover 46 of varying design.

The interface cover 46 serves the purpose of protecting the interface 38 and activating the breech locking mechanism 42. The latter enables use of the firearm (in particular firing a shot) without a firearm module 44. The interface cover 46, as well as any firearm module 44, is locked to the firearm 2 by means of element 36, if applicable, in combination with the guide means 40. Operation of the firearm module/interface cover release means 34 enables removal of the interface cover 46 or a firearm module 44. This is shown for example in FIG. 3.

Figure 6:
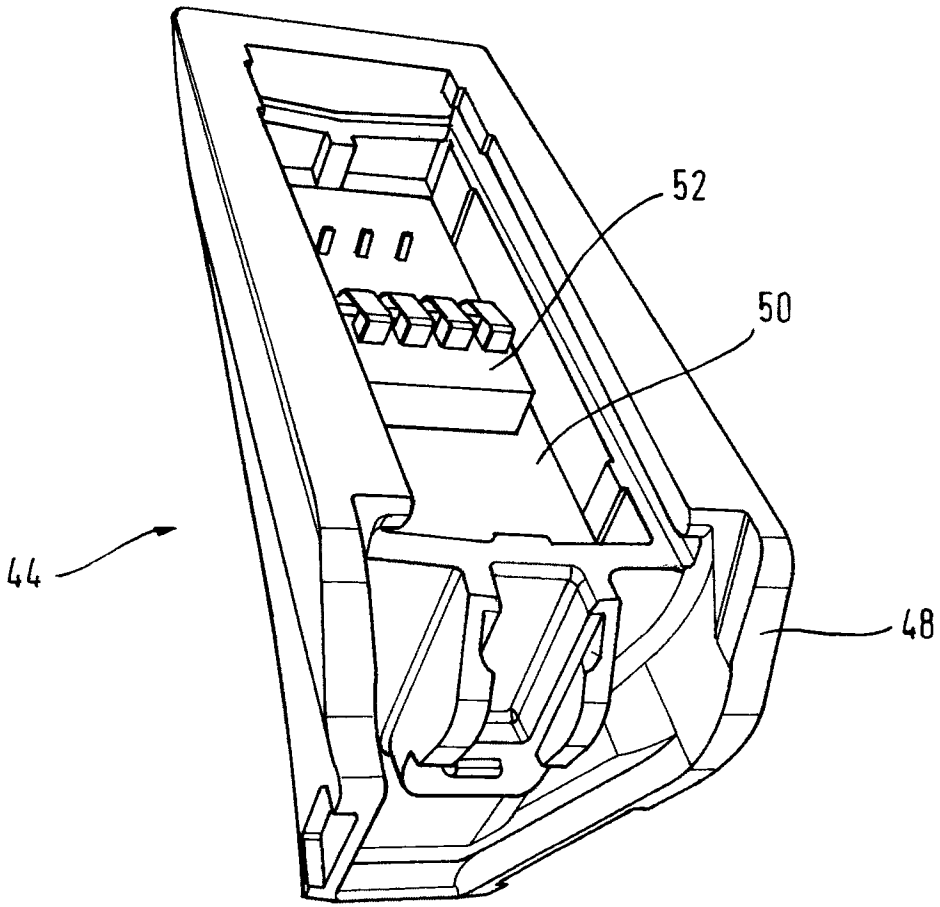
FIG. 6 shows a schematic view of an embodiment of a firearm module.
Figure 7:
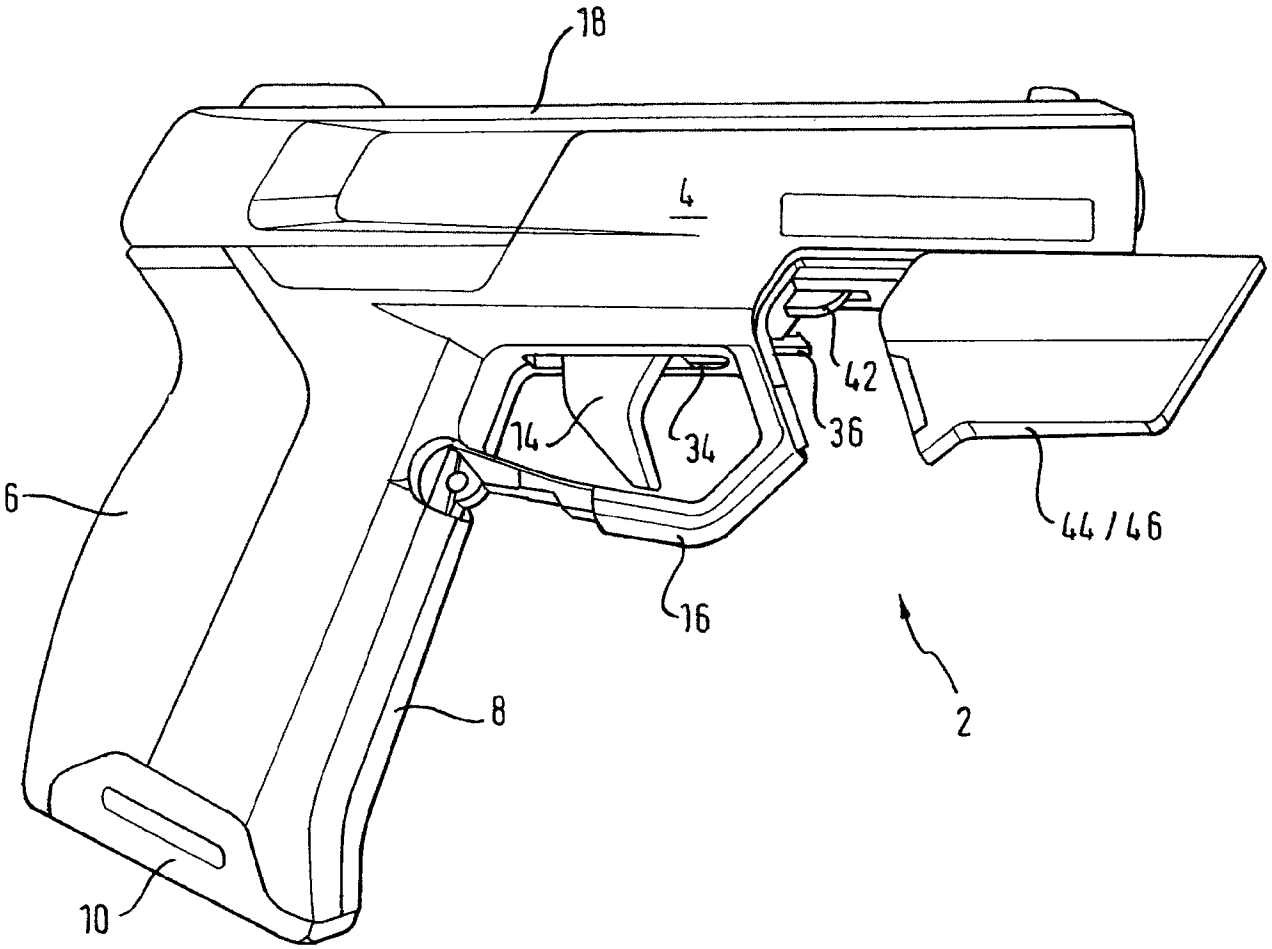
FIG. 7 shows an illustration of a firearm according to the invention with partially removed cover/firearm module.
Figure 8:
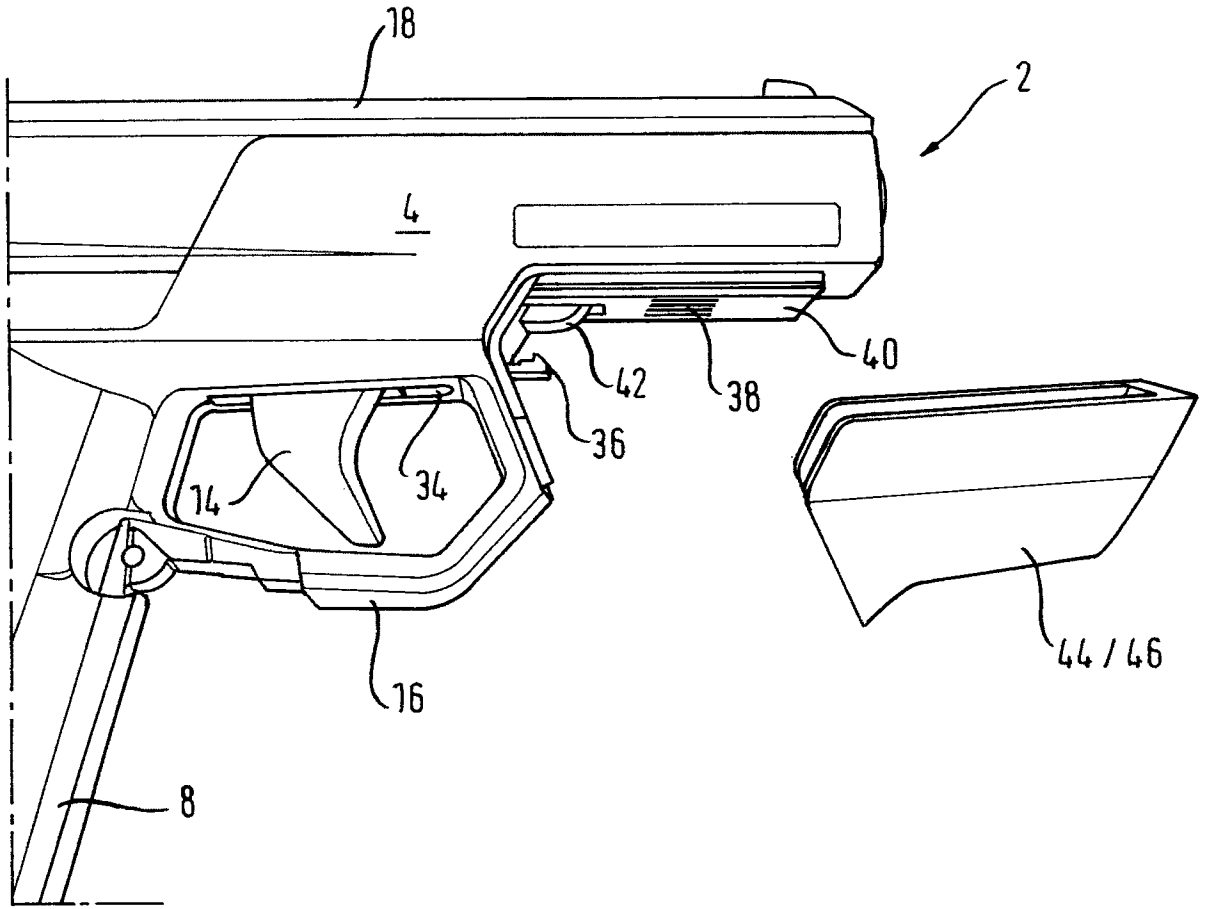
FIG. 8 shows an illustration of the firearm according to the invention of FIG. 7 with removed cover/firearm module.
Figure 9:
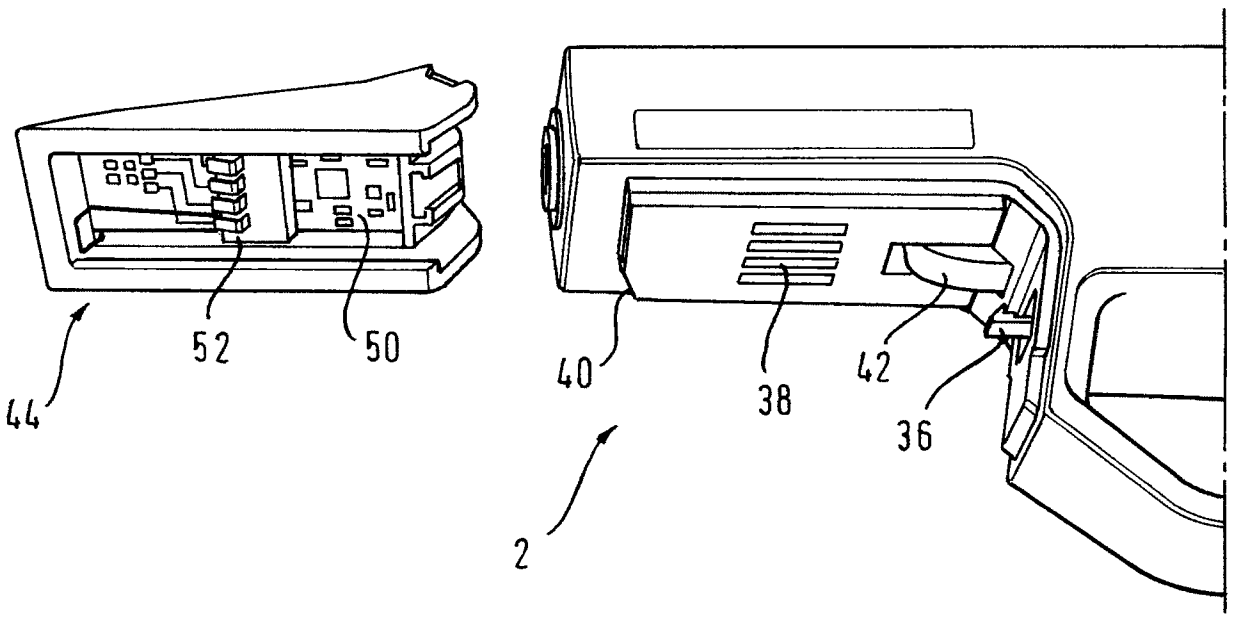
FIG. 9 shows an illustration of the firearm module interface of the firearm according to the invention of FIG. 7 and an embodiment of a firearm module according to the invention.

FIGS. 6 and 9 show embodiments of firearm modules 44. A firearm module housing 48 and an electronics unit 50 accommodated therein as well as a firearm module interface 52 are shown in said Figures. In the state arranged on the firearm 2, the firearm module interface 52 and the interface 38 of the firearm 2 contact each other. This enables communication between the firearm module 44 or the electronics unit thereof and the control means of the firearm 2.

The interface 52 shown by way of example comprises four contacts, i.e. two contacts for transmission of information and two contacts for transmission of energy. In other embodiments, the interface 52 may comprise more or less contacts and/or may be designed as a bus interface. In the case of optical, inductive and/or magnetic transmission, the interface 52 may comprise corresponding inputs and outputs, respectively.

Firearm modules 44 may comprise, for example, at least one of the following components:

- A device (e.g. comprising an electronics unit (with hard-wired logic and/or software control) and at least one sensor) for determining the position of the firearm (e.g. a GPS-based device and/or device for determination of position by means of references (e.g. transmitters) present in a specific area (e.g. firing range), for example, using transit time measurement);
- a device for detecting finger prints comprising, for example, an electronics unit (with hard-wired logic and/or software control) arranged in the firearm module 44 and a finger print sensor arranged and/or accessible at the outer surface of the firearm module 44;

a device for detecting DNA comprising, for example, an electronics unit (with hard-wired logic and/or software control) arranged in the firearm module 44 and a DNA sensor arranged and/or accessible at the outer surface of the firearm module 44;

a device for detecting infrared and/or other optical signals which can be transmitted in a wireless manner comprising, for example, an electronics unit (with hard-wired logic and/or software control) arranged in the firearm module 44 and one or a plurality of sensors arranged and/or accessible at the outer surface of the firearm module 44;

a device for detecting Bluetooth and/or other radio signals which can be transmitted in a wireless manner comprising, for example, an electronics unit (with hard-wired logic and/or software control) arranged in the firearm module 44 and one or a plurality of receivers arranged and/or accessible at the outer surface of the firearm module 44 and/or arranged in the firearm module 44;

a device for detecting voice signals comprising, for example, an electronics unit (with hard-wired logic and/or software control) arranged in the firearm module 44 and at least one microphone arranged and/or accessible at the outer surface of the firearm module 44;

a device comprising control hardware and/or software for at least partially controlling the firearm 2 in cooperation with the control means of the firearm 2 or for substituting said control means at least temporarily.

Firearm modules 44 may be provided comprising only one such device each and/or firearm modules 44 comprising at least two such devices.

It is preferably contemplated that only specific firearm modules 44 can be used with the firearm 2. For this purpose, the permissible firearm module(s) 44 may have an identifier which is provided, for example, to the control means of the firearm 2 via interfaces 52 and 38 in the state arranged on the firearm 2. The identifier may be present, for example, in an access-secure memory of the firearm modules 44 which can be read out by the control means of the firearm 2.

A device (not shown) is preferably associated with and/or integrated into the control means of the firearm 2, by means of which device, for example, signals of a watch worn by a user of the firearm (e.g. of a transponder integrated in the watch) may be detected which indicate to the firearm that the current user is authorized to use this firearm. If the firearm control means receives such an enabling signal, it enables the firearm, i.e. the user may fire a shot. This enabled state may be signaled, for example, by the optical display means 32. In case there is no such enabling signal, the firearm control means disables the firearm 2, i.e. no shot can be fired. This disabled state may also be signaled by the optical display means 32.

This locking/disabling or enabling function may be used in connection with the locking/disabling or enabling functions described in the following and provided by the firearm modules 44 or may be invalidated and substituted by one of the locking/disabling or enabling functions described in the following and provided by the firearm modules 44. In the first case, the firearm 2 is locked, if the control means of the firearm 2 or a firearm module 44 disables the firearm 2, and the firearm 2 is enabled, if both the firearm control means and the firearm module 44 enable the firearm 2. In the second case, only the respective firearm module 44 is responsible for disabling or enabling the firearm 2.

In the case of a firearm module comprising a device for determination of position, the firearm 2 can be disabled, if it is located outside a predetermined area, e.g. outside a firing range. If the firearm 2 is located inside the predetermined area (e.g. inside the firing range), the firearm 2 is enabled. Both conditions are identified by the firearm module by means of determination of position, wherein an enabling signal for the control means of the firearm 2 is generated as a function of the position of the firearm 2 and transmitted to the firearm control means via interfaces 52 and 38. The firearm control means enables the firearm 2 upon receipt of the enabling signal. If there is no enabling signal, the firearm is or remains disabled. It may also be contemplated to generate a disabling signal by means of the firearm module in case of a positioning outside a predetermined area, wherein the firearm 2 is disabled by the firearm control means upon receipt of said disabling signal.

In the case of a firearm module comprising a device for detecting finger prints, the firearm 2 can be disabled upon detection of a finger print not associated with a person authorized for use of the firearm. If a finger print associated with a person authorized for use of the firearm is detected, the firearm 2 is enabled. Both conditions are identified by the firearm module by means of finger print detection, wherein, in the case of a finger print of an authorized person, an enabling signal for the control means of the firearm 2 is generated and transmitted to the firearm control means via interfaces 52 and 38. The firearm control means enables the firearm 2 upon receipt of the enabling signal. In case there is no enabling signal, the firearm is or remains disabled. It may also be contemplated to generate a disabling signal by means of the firearm module in case of detection of a finger print of an unauthorized person, wherein the firearm 2 is disabled by the firearm control means upon receipt of said disabling signal.

In the case of a firearm module comprising a device for detecting DNA, the firearm 2 can be disabled upon detection of DNA not associated with a person authorized for use of the firearm. If DNA associated with a person authorized for use of the firearm is detected, the firearm 2 is enabled. Both conditions are identified by the firearm module by means of DNA detection, wherein, in the case of DNA of an authorized person, an enabling signal for the control means of the firearm 2 is generated and transmitted to the firearm control means via interfaces 52 and 38. The firearm control means enables the firearm 2 upon receipt of the enabling signal. In case there is no enabling signal, the firearm is or remains disabled. It may also be contemplated to generate a disabling signal by means of the firearm module in case of detection of DNA of an unauthorized person, wherein the firearm 2 is disabled by the firearm control means upon receipt of said disabling signal.

In the case of a firearm module comprising a device for detecting infrared and/or other optical signals which can be transmitted in a wireless manner, the firearm 2 can be disabled if a signal is detected indicating that the firearm 2 may be used. If no signal indicating that the firearm 2 may be used is detected or if a signal indicating that the firearm 2 may not be used is detected, the firearm 2 is enabled. In the case of a signal indicating that the firearm 2 may be used, an enabling signal for the control means of the firearm 2 is generated and transmitted to the firearm control means via interfaces 52 and 38. The firearm control means enables the firearm 2 upon receipt of the enabling signal. In case there is no enabling signal, the firearm is or remains disabled. It may also be contemplated to generate a disabling signal by means of the firearm module in absence of a signal indicating that the firearm 2 may be used or in presence of a signal indicating that the firearm 2 may not be used, wherein the firearm 2 is disabled by the firearm control means upon receipt of said disabling signal. A signal indicating that the firearm 2 may be used and/or a signal indicating that the firearm 2 may not be used can be generated, for example, by means of a transmitter arranged, for example, at/in a target, wherein—depending upon the direction in which such a signal is expected—the firearm module 44 may comprise a correspondingly arranged sensor. For example, the firearm module 44 may comprise an IR sensor at its surface facing the firing direction, which sensor receives a signal emitted by an IR sensor arranged at the target, if the firearm 2 is accordingly directed towards the target, said signal indicating that the firearm 2 may be used and/or indicating that the firearm 2 may not be used.

In the case of a firearm module 44 comprising a device for detecting Bluetooth and/or other radio signals which can be transmitted in a wireless manner, the firearm 2 can be disabled if a signal is detected indicating that the firearm 2 may be used. If no signal indicating that the firearm 2 may be used is detected or if a signal indicating that the firearm 2 may not be used is detected, the firearm 2 is enabled. In the case of a signal indicating that the firearm 2 may be used, an enabling signal for the control means of the firearm 2 is generated and transmitted to the firearm control means via interfaces 52 and 38. The firearm control means enables the firearm 2 upon receipt of the enabling signal. In case there is no enabling signal, the firearm is or remains disabled. It may also be contemplated to generate a disabling signal by means of the firearm module 44 in absence of a signal indicating that the firearm 2 may be used or in presence of a signal indicating that the firearm 2 may not be used, wherein the firearm 2 is disabled by the firearm control means upon receipt of said disabling signal. A signal indicating that the firearm 2 may be used and/or a signal indicating that the firearm 2 may not be used can be generated, for example, by means of a cellular phone, computer, etc.

In the case of a firearm module 44 comprising a device for detecting voice signals, the firearm 2 can be disabled if a voice signal or speech is detected indicating that the firearm 2 may be used. If no voice signal or speech indicating that the firearm 2 may be used is detected or if a voice signal or speech indicating that the firearm 2 may not be used is detected, the firearm 2 is enabled. In the case of a voice signal or speech indicating that the firearm 2 may be used, an enabling signal for the control means of the firearm 2 is generated and transmitted to the firearm control means via interfaces 52 and 38. The firearm control means enables the firearm 2 upon receipt of the enabling signal. In case there is no enabling signal, the firearm is or remains disabled. It may also be contemplated to generate a disabling signal by means of the firearm module 44 in absence of a voice signal or speech indicating that the firearm 2 may be used or in presence of a voice signal or speech indicating that the firearm 2 may not be used, wherein the firearm 2 is disabled by the firearm control means upon receipt of said disabling signal. This kind of voice or speech detection may also be integrated into the afore-mentioned watch, by means of which enabling signals (e.g. transponder signals) may be transmitted to the firearm control means.

Furthermore, a firearm module 44 may comprise a device including control hardware and/or software for at least partially controlling the firearm 2 in cooperation with the control means of the firearm 2 or for substituting said control means at least temporarily. Such a firearm module 44 enables provision of, for example, functions and/or modes of operation of the firearm 2 which are not provided or supported by the integrated firearm control means. Such a firearm module 44 may completely assume control of the firearm 2 or control the firearm 2 in cooperation with the integrated firearm control means.

List of Reference Numerals

2 Firearm
4 Handle piece
6 Handle back
8 Handle
10 Magazine
12 Magazine release lever
14 Trigger
16 Trigger guard
18 Breech
20 Notch sight
22 Bead sight
24 Locking spring
26 Barrel
28 Rocking lever
30 Sheet metal cage
32 Optical display means
34 Firearm module/interface cover release means
36 Element
38 Interface
40 Guide means
42 Breech locking mechanism
44 Firearm module
46 Interface cover
48 Firearm module housing
50 Electronics unit
52 Firearm module interface

The invention claimed is:

1. Firearm comprising:

a handle piece, a firearm control means integrated into the firearm, and an interface accessible from an exterior of the handle piece for an electrical connection to a replaceable firearm module and for transmission of information and energy between the firearm control means and the firearm module, wherein the interface is arranged on a side of the handle piece between a trigger guard of the firearm and a muzzle of the firearm, the firearm module is adapted to be releasably connected to the interface by coupling the firearm module to the handle piece in an area between the trigger guard and the muzzle, and wherein the firearm module includes at least one device selected from the group consisting of a device for determining the position of the firearm, a device for detecting DNA, and a device for detecting voice or speech signals.

2. A firearm comprising a firearm module for a firearm, wherein the firearm module is releasably connectable via a firearm contact interface of the firearm that is accessible and arranged on a side of a barrel between a trigger guard of the firearm and a muzzle of the firearm, said firearm contact interface is adapted for transmission of information between a firearm control means of the firearm and the firearm module, wherein the firearm module is adapted to be mechanically and electrically connected to the firearm contact interface by coupling the firearm module to the firearm in an area between the trigger guard of the firearm and the muzzle of the firearm such that the firearm module and the firearm contact interface releasably touch each other, and wherein the firearm module includes at least one device selected from the group consisting of a device for determining the position of the firearm, a device for detecting DNA, which can be transmitted in a wireless manner, and a device for detecting voice or speech signals.

* * * * *